United States Patent [19]

Cosman et al.

[11] 4,186,820

[45] Feb. 5, 1980

[54] BOARDING LADDER AND STRAPS

[75] Inventors: Dieter Cosman, Huntington, N.Y. Kathleen C. Ruppel, 04, both of Huntington, N.Y.

[73] Assignee: Henry W. Ruppel; Kathleen C. Ruppel, both of Huntington, N.Y.

[21] Appl. No.: 955,012

[22] Filed: Oct. 26, 1978

[51] Int. Cl.[2] ..... E06C 7/48; B63B 27/14

[52] U.S. Cl. ..... 182/93; 9/1.6; 182/206

[58] Field of Search ..... 182/206, 93, 107, 108; 9/1.6

[56] References Cited

U.S. PATENT DOCUMENTS

| | | | |
|---|---|---|---|
| 2,975,858 | 3/1961 | Billingsley | 9/1.6 |
| 3,169,503 | 2/1965 | Lane | 9/1.6 |
| 3,436,778 | 4/1969 | Stevens | 9/1.6 |
| 3,498,410 | 3/1970 | Storch | 182/206 |
| 3,587,123 | 6/1971 | O'Boyle | 9/1.6 |
| 3,693,573 | 9/1972 | Murphy | 9/1.6 |

*Primary Examiner*—Reinaldo P. Machado
*Attorney, Agent, or Firm*—Amster, Rothstein & Engelberg

[57] ABSTRACT

The present invention relates generally to a boarding ladder for use in conjunction with an inflatable boat having an inflated side pontoon and specifically, to an improved boarding ladder including a strap assembly for mounting the ladder to the inflatable boat. The improved boarding ladder includes a rigid ladder portion containing a pair of struts extending from the rigid ladder portion towards the boat. The struts cooperate with a horizontal cross-piece at the top of the ladder portion to mount the boarding ladder in an orientation extending downwardly and outwardly from the side of the boat and prevent the ladder from rotating under the boat when in use.

7 Claims, 6 Drawing Figures

FIG. 1
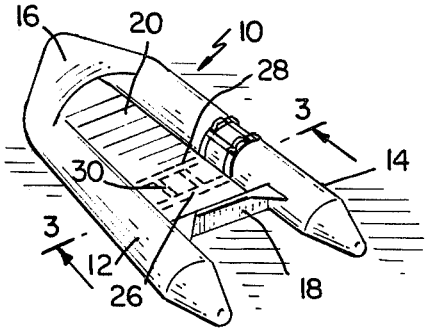
FIG. 2
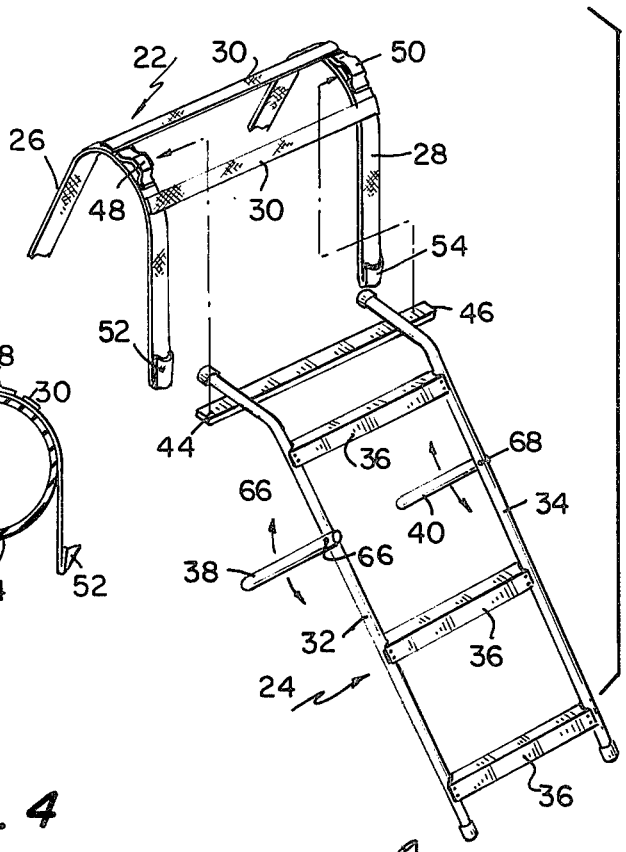
FIG. 3
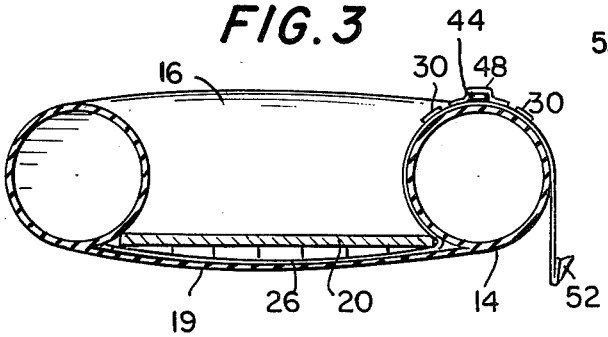
FIG. 4
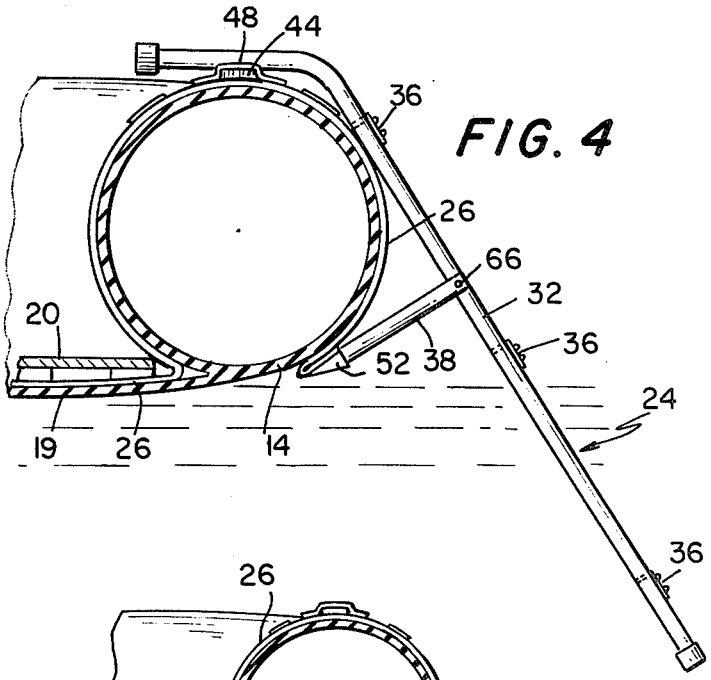
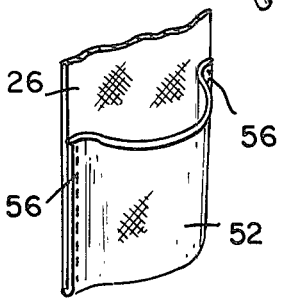
FIG. 6
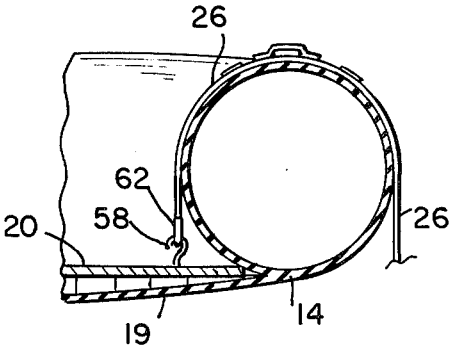
FIG. 5

BOARDING LADDER AND STRAPS

The present invention relates generally to boarding ladders to be used in conjunction with inflatable boats having inflated side pontoons of substantially circular cross-section, although it can be used in conjunction with boats having pontoons of varied cross-section. Specifically, an improved boarding ladder of the present invention is constructed to be used in conjunction with straps, or a harness, that provide removability of the boarding ladder, yet support the boarding ladder against the side of the pontoon in such manner that the ladder extends generally downwardly and outwardly from the hull and is prevented from rotating under the boat when in use.

With the increased popularity of water sports such as scuba diving, there has been a corresponding widespread rise in the use of lightweight, inflatable boats such as the type manufactured by Zodiac S. A. of France. Zodiac-type boats typically are formed from a pair of inflatable side pontoons of generally circular cross-section. The side pontoons are joined at one end to form the bow of the boat. The other end of the pontoons are joined by a transversely extending, vertical, wooden transom. A watertight assembly is provided by a bottom sheet of rubber material connecting the side pontoons and the transom. A set of wooden floorboards above the bottom sheet completes the assembly.

Because of their size and stability, Zodiac-type boats are often used by divers. However, since diving apparatus, e.g., air tanks and regulator, are heavy, boarding a boat is difficult for a diver wearing equipment. Conventional boarding ladders available for use in conjunction with inflatable boats make boarding even more difficult because they have the disadvantage of rotating laterally under the boat when in use. This disadvantage grows out of the fact that inflatable boats inherently do not provide convenient surfaces upon which the boarding ladder can be mounted in a manner that would prevent rotation. For example, although the surfaces of the side pontoons contain several attachment points including eyes in a lacing cuff, there is no means for rigidly mounting a ladder to the boat in a manner that will prevent rotation. Additionally, the typical boarding ladder is comprised of rope or other flexible vertical members connecting the rungs. Such flexible ladders are inherently incapable of functioning in the manner of the improved boarding ladder of the present invention. Specifically, as soon as a swimmer places his feet on the rungs of a rope ladder, the rungs rotate under the boat.

Other conventional boarding ladders of the rigid type are not conveniently mountable to inflatable boats. Typical boarding ladders contain hooked portions at the topmost ends of the side rails. The hooked portion is placed over the side of the boat. Such ladders are not suited to inflatable boats as the hooks are not large enough and, even more significantly, contain no means in the mounting to prevent rotation of the ladder under the boat when in use.

Consequently, it is an overall object of the present invention to provide an improved boarding ladder that can be used in conjunction with an inflatable boat and, by virtue of the novel mounting means, be maintained in a position whereby the ladder extends substantially downwardly and outwardly from the side of the boat when in use.

It is a further object of the present invention to provide an improved boarding ladder that is used in conjunction with straps or a harness to mount the ladder from either side of the boat, at a position anywhere along the length of the boat.

It is a further object of the present invention to provide a ladder that accomplishes the above objects, yet is readily removable from the boat when not in use.

It is a further object of the present invention to provide a boarding ladder that does not require permanent modifications to the existing inflatable boat structure.

It is a still further object of the present invention to provide a boarding ladder that is inexpensive to manufacture, yet sturdy and reliable.

In accordance with one embodiment of the present invention, demonstrating objects and features of the present invention, there is provided a boarding ladder assembly for use in conjunction with an inflatable boat having an inflated side pontoon comprising a ladder portion including a pair of substantially vertical rigid side rails and a plurality of substantially horizontal rungs. A substantially horizontal cross-piece connects the upper ends of the pair of side rails and includes a horizontal projection extending outwardly from each side rail. A pair of struts extend from the ladder portion towards the side pontoon of the boat. The ladder assembly includes a harness wrapped around the side pontoon which extends downwardly on the outside of the pontoon which incorporates means for fastening the harness to the boat. The harness also includes means for engaging the horizontal projections of the cross-piece therein and means for engaging the pair of struts. In use, the ladder portion will project downwardly and outwardly from the side of the boat and be prevented from rotating about the pontoon to an orientation where the ladder is under the boat as in conventional boarding ladders.

The above brief description as well as further objects and features and advantages of the present invention will be more fully understood by reference to the following detailed description of the presently preferred but nonetheless illustrative embodiment of an improved boarding ladder in accordance with the present invention, when taken in conjunction with the accompanying drawings, wherein:

FIG. 1 is a perspective view of an inflatable boat having side pontoons showing the installation of the harness portion of the present invention;

FIG. 2 is a perspective view of the components of the improved boarding ladder of the present invention with a fragment of the harness shown;

FIG. 3 is a sectional view taken along the line 3—3 in FIG. 1 showing the tail of the harness extending below the floor boards of the boat;

FIG. 4 is an enlarged sectional view through one pontoon showing the engagement of the ladder portion within the harness;

FIG. 5 is a partial sectional view through one pontoon showing an alternate mounting of the harness to the floor board; and, FIG. 6 is an enlarged detail showing the terminus of the harness portion adapted to receive the struts.

Referring now to the drawings, and in particular to FIG. 1, there is shown an inflatable Zodiac-type boat generally designated by the reference numeral 10. Boat 10 includes a left or port pontoon 12 and a right or starboard pontoon 14. The two pontoons 12, 14 are connected at the front or bow 16 and at the rear or stern by transom 18. The watertight integrity of boat 10 is provided by a rubber floor sheet 19 interconnecting pontoons 12, 14 and transom 18. A rigid floor structure is provided by floor boards 20 extending transversely across the bottom of boat 10 above floor sheet 19.

FIG. 2 shows the two primary components of the improved boarding ladder of the present invention. Specifically, the improved boarding ladder is comprised of harness means generally designated by the reference numeral 22 and a ladder portion generally designed 24. The harness means 22 is made of two, substantially parallel, transversely extending side straps 26, 28. As best shown in FIG. 1, side straps 26, 28 extend transversely across the entire width of boat 10 between floor boards 20 and floor sheet 19. A series of cross-straps 30 are provided throughout the length of side straps 26, 28 connecting the side straps and maintaining substantially constant spacing between side straps 26, 28 along their entire respective lengths. The harness means can be made from readily available, relatively inexpensive nylon webbing similar to the material used in automotive seat belts.

Ladder portion 24 is comprised of two, substantially parallel, side rails 32, 34. A series of ladder rungs are connected to said side rails and extend from one side rail to the other providing both rigidity to the ladder portion 24 and serving as steps of the ladder.

FIG. 3 is a cross-section of boat 10 taken along the line 3—3 in FIG. 1, just aft of harness means 22 showing side strap 26 extending transversely across boat 10 between floor boards 20 and floor sheet 19. Floor boards 20 are installed above floor sheet 19 of boat 10 prior to the inflation of pontoon 12, 14. Upon inflation, floor boards 20 are maintained in firm contact with pontoons 12, 14 thereby preventing relative motion between floor boards 20 and the pontoons. By installing the remote ends of side straps 26, 28 under the floor board 20 as shown in FIG. 3, upon inflation of pontoons 12, 14, harness means 22 is firmly fixed to boat 10. The opposite end of side straps 26, 28 are merely draped around right pontoon 14 with the ends of side straps 26, 28 extending substantially downward from pontoon 14. There is no need to make any permanent modifications to boat 10. Further, harness means 22 can be mounted anywhere along the length of either pontoon 12 or 14.

Ladder portion 24 contains struts 38, 40 rotatably mounted to side rails 32, 34, respectively. Additionally, a cross-bar 42 is fixedly mounted to the upper ends of side rails 32, 34. Cross-bar 42 contains side projections 44, 46, extending outwardly from side rails 32, 34, respectively. Struts 38, 40 and side projections 44, 46 cooperate with harness means 22 to mount ladder portion 24 to harness means 24 in such manner that, when in use, ladder portion 24 assumes an orientation that facilitates use of the boarding ladder of the present invention.

Specifically, as best shown in FIG. 2, harness means 22 contains projection receiving, attaching eyes 48, 50 on side straps 26, 28, respectively. Additionally, the ends of side straps 26, 28 each contain a strut receptacle 52, 54. The detail of FIG. 6 shows a preferred construction for a strut receptacle 52, 54, which is formed by merely bending a portion of side strap 26, 28 approximately two inches long over itself and stitching or riveting a longitudinally extending seam 56 along the doubled over portions of side straps 26, 28, thereby forming a pocket.

To mount ladder portion 24 in harness means 22, side projections 44, 46 are engaged in the respective projection receiving attaching eyes 48, 50. Ladder portion 24 is then rotated downwardly causing struts 38, 40 to be received in strut receptacles 52, 54, respectively. Further, downward rotation of ladder portion 24 causes said ladder to assume the orientation shown in FIG. 4 whereby ladder portion 24 lightly rests against the outer surface of pontoon 14 until the cooperation between the side projections 44, 46 and attaching eyes 48, 50 and struts 38, 40 and receptacles 52, 54 prevent further downward rotation of ladder portion 24. Eyes 48, 50 oppose the tendency of the top of ladder portion 24 to rotate upwardly when the ladder is in use and strut receptacles 52, 54 prevent downward rotation of the bottom of ladder portion 24.

When not in use, ladder portion 24 is readily removable from harness means 22. Specifically, to disengage the ladder portion from the harness, ladder portion 24 is simply rotated upwardly causing struts 38, 40 to disengage from strut receptacles 52, 54. Next, ladder portion 24 is caused to move fore or aft a small distance disengaging either side projection 44 or 46 from its corresponding attaching eye 48 or 50. Finally, the ladder portion may simply be lifted into the boat.

The side rails 32, 34 of ladder portion 24 can be made out of readily available material that is corrosion resistant, such as aluminum or stainless steel tubing or wood, and the rungs 36 made from such materials as wood, plastic or aluminum.

FIG. 5 shows an alternate embodiment of the present invention. In FIG. 5, hooks 58 engage corresponding eyes 62 in side straps 26, 28, respectively. Hooks 58 are mounted directly to floor board 20 thereby obviating the need for side straps 26, 28, extending under floor boards 20.

An additional alternate construction of the harness means 22 of the present invention (not shown) utilizes side straps 26', 28' approximately twelve inches longer than the straps utilized in the alternative embodiment shown in FIG. 5. In this additional alternate embodiment, the remote ends of side straps 26', 28', are folded over several times and stitched or riveted to form a thickened portion. The thickened portion is then wrapped around pontoon 14 in the same manner as the preferred embodiment described above and placed under floor boards 20 in the proximity of the engagement of floor boards 20 with the inner surface of pontoon 14 adjacent the floor boards. In such case, the intersection of the floor boards with pontoon 14 prevents harness means 22 from being pulled away from floor boards 20. The ladder portion 24 is installed in harness means 22 in the same manner described above and the improved boarding ladder of the present invention functions in all other respects as described above.

To facilitate storage of the ladder portion of the present invention when not in use, struts 38, 40 are rotatably mounted to side rails 32, 34, respectively about swivel pins 66, 68. The swivel enable struts 38, 40 to be rotated parallel to side rails 32, 34. Additionally, although the portion of side rails 32, 34 extending upwardly above the first rung 36 is shown bent downwardly approximately 45° from the axis of the side rails, the ladder portion 24 of the present invention can be formed with straight rails again to facilitate storage. In such instance, projection receiving attaching eyes 48, 50 need only be located at an orientation rotated a few degrees in the clockwise direction shown in FIGS. 3 and 4 or eyes 48, 50 need merely be made larger.

Unlike conventional boarding ladders, the present invention relates specifically to an improved boarding ladder that, by virtue of its unique harness assembly and mounting arrangement, will be ridigly held in substantially the orientation shown in FIG. 4. Therefore, the improved boarding ladder of the present invention is suitable for use by swimmers in general and divers in particular since the orientation of the ladder makes it easier to board an inflatable boat, even with the added load of underwater breathing apparatus.

Although the invention herein has been described with reference to particular embodiments, it is to be understood that these embodiments are merely illustrative of the principles and application of the invention. Thus, it is to be understood that numerous modifications may be made in the illustrative embodiment and other arrangements may be devised without departing from the spirit and scope of the invention and, consequently, the claims appended hereto should be broadly construed.

What is claimed is:

1. A boarding ladder for use in conjunction with an inflatable boat having a rigid floorboard and an inflated side pontoon comprising:

a ladder portion including a pair of substantially vertical side rails and a plurality of substantially horizontal rungs mounted to said rails;

a horizontal projection extending from each side rail;

a pair of struts extending from said ladder portion substantially perpendicular to a plane defined by said side rails;

a harness means fastening said harness to said boat whereby said harness is wrapped outwardly around said pontoon and extends downwardly therefrom;

said harness includes first means for removably engaging said horizontal projections of said side rails with said harness and second means for engaging ends of said pair of struts remote from ends communicating with said side rails in said harness whereby when engaged in said harness said ladder portion will project downward and upward from an inflated side pontoon of an inflatable boat and will be prevented from rotating about said pontoon under said boat.

2. The boarding ladder recited in claim 1 wherein said harness is comprised of two substantially parallel straps extending transverse to an axis of said pontoons across said boat under a floorboard of said boat removably fastened between a side of said floorboard adjacent a pontoon and said pontoon.

3. The boarding ladder recited in claim 2 wherein said first projection engaging means comprises a strap segment fastened to said harness forming strap in superposed relationship to said harness forming strap forming an eye between said harness forming strap and said strap segment to removably engage said horizontal projection of said cross-piece.

4. The boarding ladder recited in claim 2 wherein said strut engaging means comprises a receptacle formed at an end of each of said two substantially parallel straps remote from said ends of said strap engaging said floorboards removably receiving said strut within said receptacle and located along said strap a distance from said projection engaging means corresponding to a distance between said projection and said strut to maintain said ladder portion oriented downwardly and outwardly from said boat when said ladder is in use.

5. The boarding ladder recited in claim 1 further including rotatable mounting means connecting said struts to said ladder portion, said strut adapted to rotate from said position extending from said ladder portion substantially perpendicular to a plane defined by said side rails to a second storage position substantially parallel to said plane.

6. The boarding ladder recited in claim 1 wherein said means for fastening said harness to said boat is comprised of an eye on said harness at an end of said harness remote from said end containing said second means for engaging said ends of said pair of struts and a hook fastened to a floorboard of said boat in engaging relationship with said eye on said harness.

7. A boarding ladder for use in conjunction with an inflatable boat having a rigid floorboard and an inflated side pontoon of substantially circular cross-section comprising:

a ladder portion having a pair of substantially vertical side rails and a pluraity of substantially horizontal rungs mounted to said side rails;

a pair of ladder portion fastening projections extending from said side rails;

a pair of rigid struts rotatably mounted to said side rails rotatable from a first position extending substantially perpendicular to a plane defined by said side rails to a second storage position substantially parallel to said plane;

a mounting harness having a pair of substantially parallel straps with each said strap having a first end removably fastened to a floorboard inside said boat a portion of said strap extending over said pontoon and a second end of each said strap outside said boat;

said straps include ladder fastening projection receiving eyes thereon along said portion of said strap adjacent a top half of said circular cross-section of said pontoon and a strut receptacle at said second end of said strap spaced from said ladder fastening projection receiving eyes a distance corresponding to a distance between said ladder portion fastening projections and said struts whereby the engagement of said projections in said eyes and said struts in said receptacles will maintain said ladder portion in said mounting harness on the outside of an inflated side pontoon of an inflatable boat in an outward and downward orientation to said boat.

* * * * *

UNITED STATES PATENT AND TRADEMARK OFFICE

CERTIFICATE OF CORRECTION

PATENT NO. : 4,186,820

DATED : February 5, 1980

INVENTOR(S) : Dieter Cosman

It is certified that error appears in the above-identified patent and that said Letters Patent are hereby corrected as shown below:

The sole inventor is DIETER COSMAN, Huntington, New York.

Signed and Sealed this

*Twenty-fourth* Day of *June 1980*

[SEAL]

*Attest:*

SIDNEY A. DIAMOND

*Attesting Officer*

*Commissioner of Patents and Trademarks*